US006123051A

United States Patent [19]

Kubina et al.

[11] Patent Number: 6,123,051

[45] Date of Patent: Sep. 26, 2000

[54] SHROUD FOR AN ENGINE COOLING FAN

[75] Inventors: Joseph E. Kubina, Oxford; Mark C. Schram, Lake Orion; Aaron P. Running, Rochester Hills; Kent Lassen, Southfield, all of Mich.

[73] Assignee: Chrysler Corporation, Auburn Hills, Mich.

[21] Appl. No.: 09/185,214

[22] Filed: Nov. 3, 1998

Related U.S. Application Data

[63] Continuation-in-part of application No. 09/132,884, Aug. 12, 1998.

[51] Int. Cl.[7] ..... F01P 7/10

[52] U.S. Cl. ..... 123/41.49; 416/189

[58] Field of Search ..... 123/41.49; 415/208.2, 415/185, 191; 416/169 A, 189

[56] References Cited

U.S. PATENT DOCUMENTS

| | | | |
|---|---|---|---|
| 3,779,341 | 12/1973 | Huggins | 123/41.49 |
| 3,832,085 | 8/1974 | DeFauw et al. | 123/41.49 |
| 3,845,903 | 11/1974 | Runninger | 416/189 |
| 4,116,269 | 9/1978 | Ikeda | 123/41.49 |
| 4,189,281 | 2/1980 | Katagiri | 123/41.49 |
| 4,265,348 | 5/1981 | Clarke | 192/58 B |
| 4,329,946 | 5/1982 | Longhouse | 123/41.49 |
| 4,505,641 | 3/1985 | Tsuchikawa | 416/189 |
| 4,971,143 | 11/1990 | Hogan | 123/41.49 |
| 5,224,447 | 7/1993 | Braatz et al. | 123/41.47 |
| 5,410,992 | 5/1995 | Hunt et al. | 123/41.49 |
| 5,588,482 | 12/1996 | Holka | 123/41.49 |
| 5,701,854 | 12/1997 | Hauser | 123/41.49 |
| 5,709,175 | 1/1998 | Carroll | 123/41.49 |
| 5,758,716 | 6/1998 | Shibata | 123/41.49 |

*Primary Examiner*—Thomas N. Moulis
*Attorney, Agent, or Firm*—Kenneth H. Maclean

[57] ABSTRACT

A shroud for a vehicle engine cooling fan mounted to a generally rectangular radiator that has fixed air guide vanes in strategic areas of the shroud outside of the periphery of the fan blades to direct and channel streams of peripheral air flowing through the corners of the radiator into these areas inward and in a swirling pattern into the fan blades and more particularly in a generally smooth and circuitous path counter to the direction of rotation of the fan and directly onto the pumping surfaces of the fan blades. This effectively feeds additional air into the fan and preloads the blades so that air pumping efficiency is resultantly improved and more air is moved through the radiator for improved heat exchange.

14 Claims, 3 Drawing Sheets

SHROUD FOR AN ENGINE COOLING FAN

BACKGROUND OF THE INVENTION

Cross Reference to a Related Application

This patent application is a continuation-in-part of a previously filed and copending application by the same inventors, entitled "Shroud for an Engine Cooling Fan"; filed Aug. 12, 1998 assigned Ser. No. 09/132,884.

FIELD OF THE INVENTION

This invention generally relates to cooling of an internal combustion engine of a vehicle and more particularly to a new and improved fan shroud for an engine adapted to overlie a generally rectangular shaped radiator and featuring internal vanes arranged in strategic corner areas in the shroud that direct peripheral air passing through the corners of the radiator directly to the fan blades so that the blades are preloaded so as to enhance fan efficiency in pumping air through the radiator therefore improving the overall heat exchange for the engine.

SUMMARY OF THE INVENTION

Vehicles typically include an internal combustion engine, a radiator for cooling the engine, and an engine driven fan for causing air to flow through the radiator. Under idle and lower speed operation, the ability of the radiator to cool the engine is determined, in part, by the capacity of the cooling fan in producing an air flow through the radiator, often referred to as the fan efficiency or capacity. Accordingly, vehicle manufacturers are always looking for simple and inexpensive ways in which to increase engine cooling fan efficiency.

Most engine cooling fans are encircled by a shroud member which are designed to enhance the efficiency of the cooling fan as well as to prevent the insertion of foreign objects, such as debris, or tools, into the blades of a moving fan. Accordingly, it would be desirable to maximize the efficiency of the shroud by providing vanes which define air channels that increase air flow through the radiator and to the engine cooling fan. The subject invention provides a fan shroud intended for use with an engine driven fan which has blades that rotate in a predetermined direction. The fan shroud includes a generally flat deflecting portion having a surface spaced from and overlying the generally rectangular configured radiator. The deflecting portion is integrally connected to a tubular collar or ejector portion defining an aperture sized and positioned to receive the fan. Also, a reinforced edge is disposed along the outer perimeter of the deflecting portion. A plurality of vanes, each having a generally semi-circular shape, extend between the reinforced edge and the aperture of the collar portion. These vanes direct streams of air from the radiator, particularly corner portions thereof, to the fan receiving aperture portion and in a direction opposite to the predetermined rotation of the fan blades. In the preferred embodiment of the present invention, the vanes are arranged in substantial parallelism to form rows therebetween from the reinforced edge and the collar's aperture so as to define separate air channels between adjacent vanes.

The present invention overcomes several shortcomings of prior art engine fan shrouds. Foremost, the present invention increases both engine cooling performance and air conditioning performance. Further, the subject shroud is strong, durable, and easily serviced.

Prior to the present invention, various fan shroud arrangements have been provided for automobile engine cooling fans. U.S. Pat. No. 5,224,447 dated issued Jul. 6, 1993 for "An Air Guide For A Fan Impeller Of An Internal Combustion Engine" discloses a cowl ring disposed around an engine cooling fan having a plurality of outflow openings and associated external air guide vanes for improving the radial outflow of the fan to reduce pressure losses in the outflow in a radial direction. U.S. Pat. No. 5,410,992 issued May 2, 1995 for "Cooling System For Automotive Engine" discloses a variable geometry fan duct having a fixed barrel segment for an axial flow cooling fan and a movable barrel segment rotatably mounted on the fixed segment movable to a position in which the fan blades are completely encircled to provide the variable geometry. U.S. Pat. No. 4,329,946 issued May 18, 1982 for "Shroud Arrangement For Engine Cooling Fan" discloses fixed and rotatable shrouds for an associated engine cooling fan to improve the efficiency of the fan.

While the prior art disclosures provide different shroud structures for engine cooling fans to improve fan performance, they do not meet higher standards for improved air intake into the fan and particularly an improvement in air flow associated with the corner areas of the fan shroud and the associated rectangular radiator. Nor do they actively direct air to the pumping surfaces of the engine cooling fan blades for increasing fan pumping efficiency. More particularly the prior art does not disclose or suggest the strategic arrangement of vanes located internally of the fan shroud and particularly in the corner areas thereof for controlling and directing the air flowing through the corner regions of the radiator and creating a swirling air flow pattern directed to pass air toward the pumping surfaces of the fan blades so that the blades are preloaded and therefore more efficient to pump larger quantities of air in a more effective operational mode of air flowing through the radiator. Thus, the present invention increases the cooling performance of the radiator type cooling system for an internal combustion engine and even increases the air conditioning performance of an associated air conditioning condenser by increasing air flow therethrough at all engine and vehicle speeds. With this invention fan noises are decreased and the shroud is structurally stronger while accessibility and serviceability of the fan is maintained.

In a preferred embodiment of this invention, a multi-bladed axial or mixed flow fan is encircled by a collar or curved ejector portion of a fan shroud which extends rearwardly from an open box section or flow diverting portion thereof. The flow diverting portion is supported in overlying relationship to a generally rectangular radiator. Air flows through the radiator when the fan is operational, particularly when the engine is idling or under lower speeds of the vehicle. Under these conditions, an improvement in heat exchange of the radiator cooling system is very desirable. In regions radially outward of the generally circular fan, streams of peripheral air are feed to the fan, i.e., air outward of the fan's diameter passes through the comers of the radiator and radially inward to the fan. In the subject arrangement, the peripheral air flow is channeled by a plurality of curved vanes formed in the flow diverting portion of the shroud and directed inwardly in a swirling pattern in a rotational direction counter to the fan's normal rotational direction. The inwardly swirling flow of this air desirably preloads the fan blades by impinging on the working side of the fan blades so that the fan's air pumping and heat exchange efficiencies are improved. Moreover, the internal vanes provide improved structural strength to the shroud. The subject vane arrangement further reduces noise levels originating from fan operation and improves the efficiency of the air conditioning system particularly where the air conditioning condenser is located adjacent to the radiator and the shrouded fan pulls greater quantities of outside air over the total surface of the condenser.

Another feature and object of this invention is to provide a new and improved fan shroud, adapted to accommodate a rotatable multi-bladed engine cooling fan, having internal vanes in strategic areas such as the corners of the shroud that direct inwardly swirling streams of air into the rotating fan and in a rotational direction counter to the direction of fan rotation to preload the pumping surfaces of the fan blades to improve fan output and operating efficiency.

These and other features of the invention will become more apparent from the following detailed description and drawings.

DETAILED DESCRIPTION OF THE PREFERRED EMBODIMENT

Figure 1:
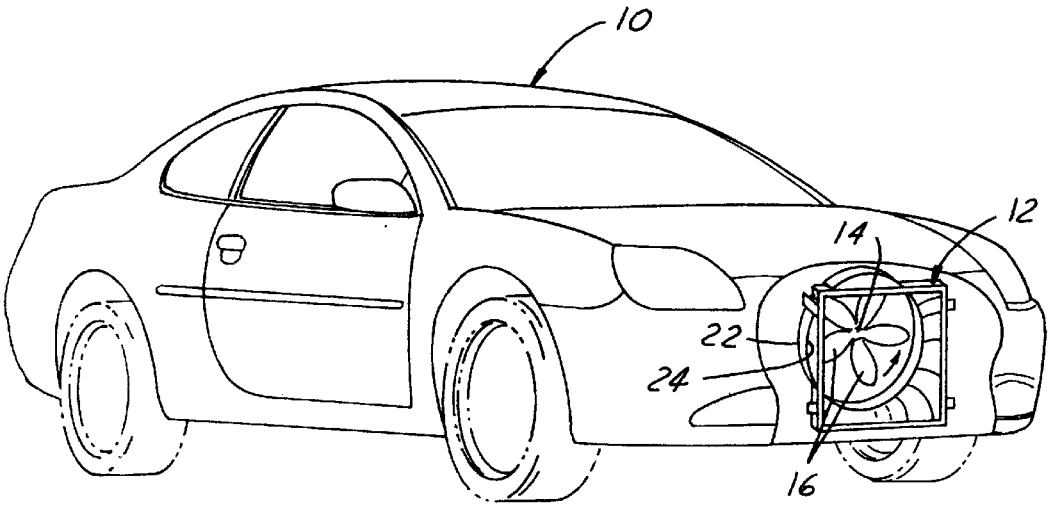
FIG. 1 is a perspective view of a vehicle with portions of its front end broken away, such as the radiator, to expose an engine fan and a fan shroud in accordance with the present invention.

Turning now in greater detail to the drawing, FIG. 1 shows a perspective view of a vehicle 10 with portions of a front end of the vehicle 10 broken away to expose an engine fan shroud 12 in accordance with the present invention. The shroud 12 is designed to shield an engine driven fan 14 commonly referred to as an engine cooling fan. The engine cooling fan 14 includes blades 16 which rotate in a predetermined direction. As illustrated in FIG. 1, the blades 16 of the engine cooling fan 14 rotate in counter-clockwise rotation, generally indicated by the dashed arrow. Rotation of the fan 14 draws air through an engine radiator which has been removed in FIG. 1 to better illustrate the shroud 12 and fan 14. The radiator is shown in latter views to be described hereinafter.

Figure 3:
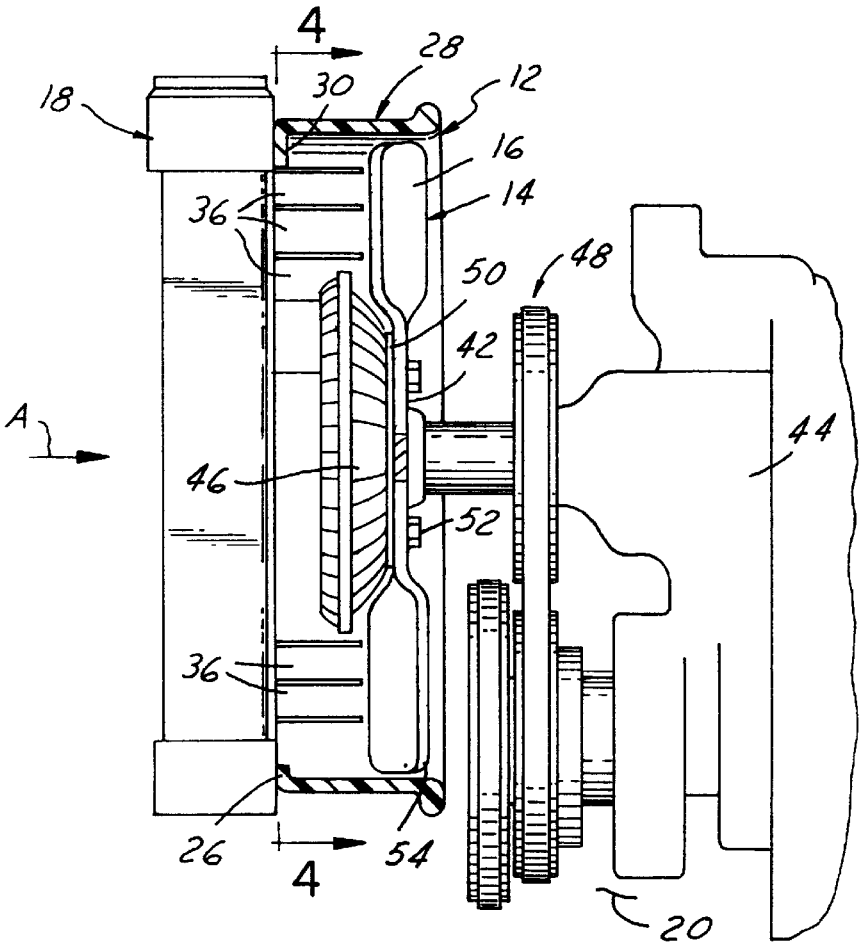
FIG. 3 is a elevational view partially in section of an engine fan, an associated fan shroud, a radiator, and also showing a portion of the vehicle engine which rotates the fan.
Figure 2:
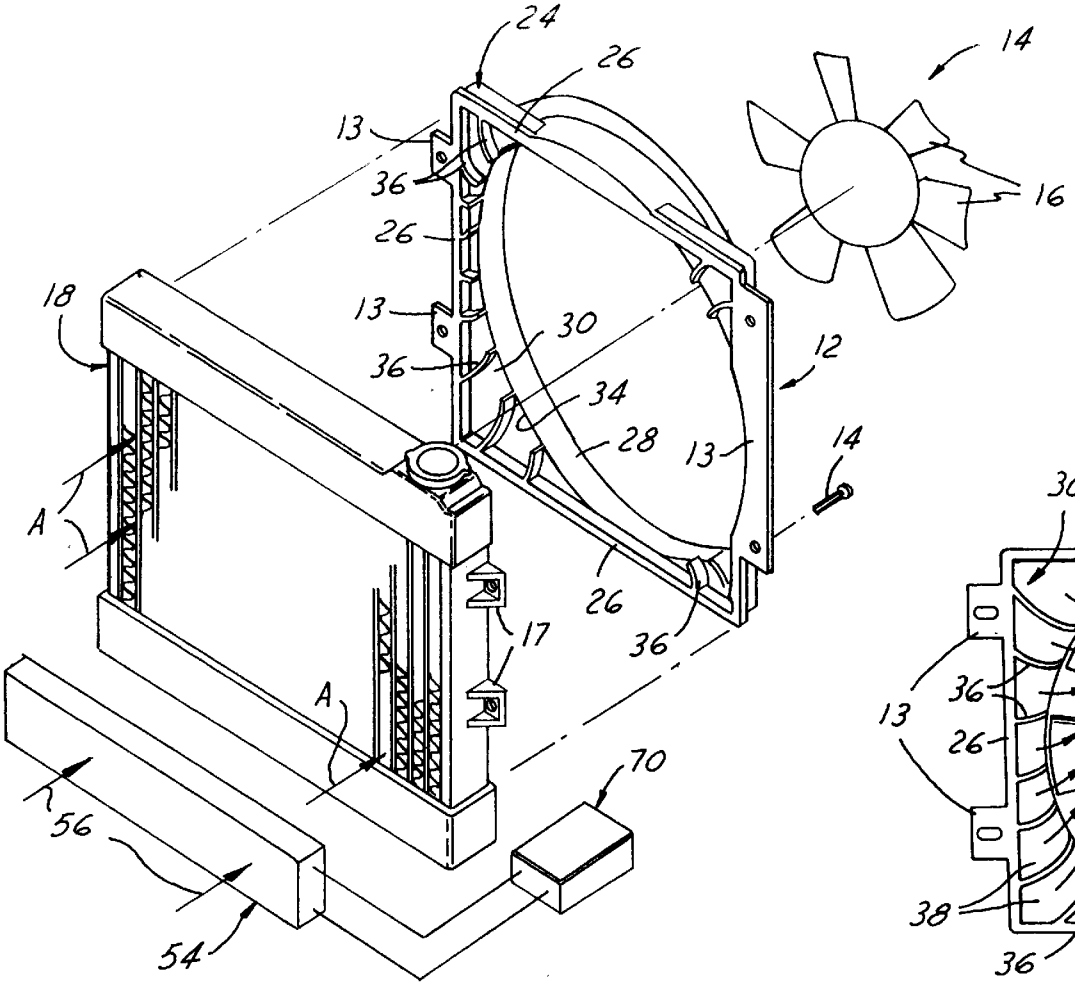
FIG. 2 is a pictorial view of an engine driven cooling fan, and associated fan shroud, a conventionally rectangularly shaped radiator for circulating engine coolant therethrough, and a vehicle air conditioning condenser.

FIGS. 2 and 3 show fan shroud 12 as including integral attachment tabs 13 for receiving threaded fasteners 15 (see FIG. 5) which operatively secure the shroud to bracket structure 17 associated with an engine coolant circulating radiator 18. Radiator 18 has a conventional rectangular configuration through which air flows as indicated by arrowed lines A in FIG. 2. Alternatively, the bracket structure or other shroud support could be attached to some other structure in the engine compartment 20 of the associated vehicle. The fan shroud 12 is molded or otherwise formed from an engineering plastics or other suitable material. Preferably, the fan shroud 12 has a box-like main body portion 24 best seen in FIG. 2. The main body portion 24 has an opened front face which is bordered by and defined by a generally rectilinear wall portion 26. The shroud is supported via wall portion 26 as it includes the tab portions 13 previously discussed. The shroud 12 also includes a generally cylindrically configured collar portion 28 which extends axially from an interior surface of a back wall 30 of the main body portion 24. Collar portion 28 is adapted to encircle the fan 14 and its blades 16. This relationship with the fan serves to allow the collar portion to act as an air ejector or enabler for air flow from the interior of the main body portion 24 and thus from the radiator 18.

Figure 4:
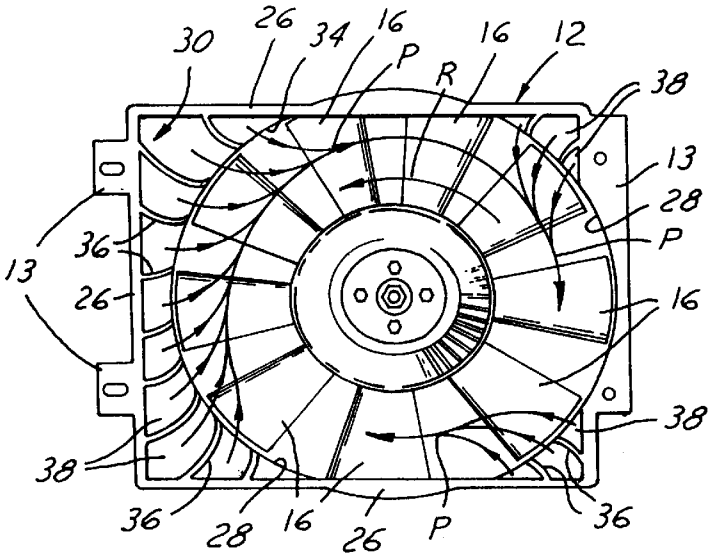
FIG. 4 is a sectional view taken generally along section line 4 - 4 of FIG. 3.

FIGS. 2 and 4 best show the interior regions of the body portion 24 of the fan shroud 12. Shroud 12 includes the wall portions 30 which extend radially inward from the outer wall portion or frame 26 to the collar or ejector portion 28. Specifically, the wall portions 30 extend from corner portions of the rectangularly configured main body portion 24 to the central collar 28. The wall portions 30 connect with the collar at an inner or leading edge portion 34 which forms a transition between the interior of the main body portion and the collar portion. The wall portions 30 supports a plurality of curved air directing vanes 36 which extend away from the interior surface. In a preferred embodiment, the vanes are integrally formed with the main body portion 24 but the vanes could be otherwise secured to the shroud.

Figure 5:
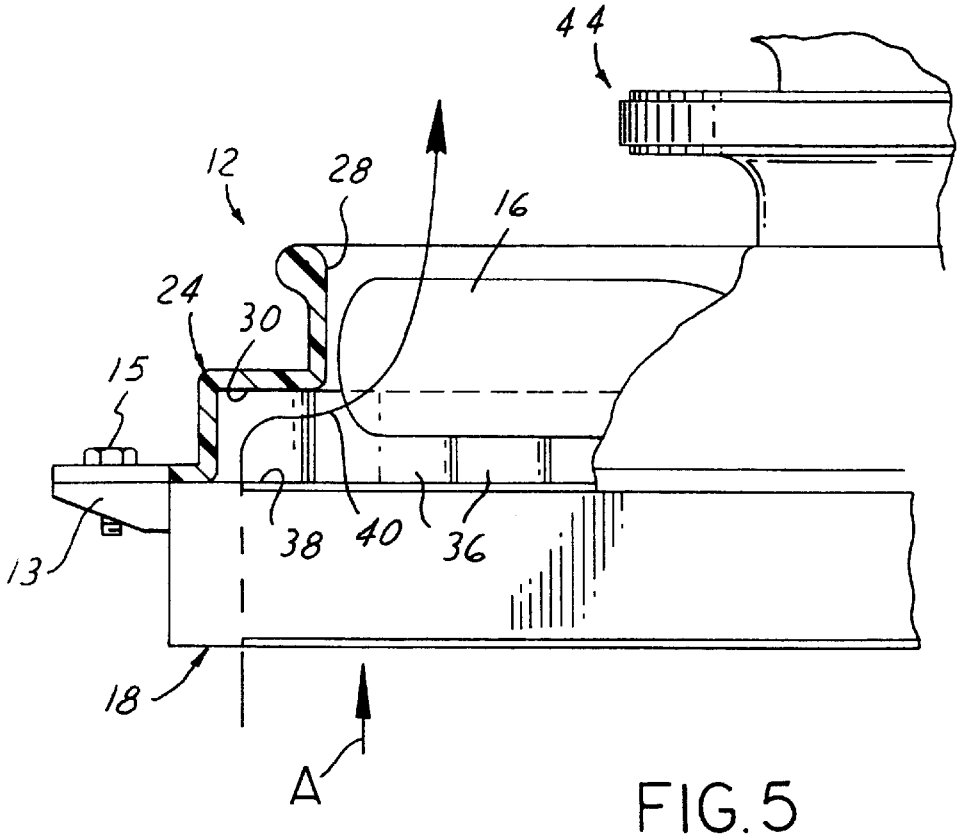
FIG. 5 is an enlarged view similar to FIG. 3 of a portion of the fan, the shroud, and the radiator.

The vanes 36 are located radially outward and generally upstream of collar portion 28 and spaced from one another to form air flow passages or channels 38 therebetween. Since the vanes are substantially located at the corners of the main body portion 24 of the shroud and radiator 18, these passages 38 permit air exiting peripheral or outer corner portions of the radiator to pass away from the radiator's downstream discharge surface and then flow radially inward as best illustrated in FIG. 5 by the arrowed line 40. As seen in FIG. 4, the vanes 36 also cooperatively impart an inwardly directed and rotational swirling pattern or stream of air labeled as path P. The rotation of the swirling air along paths P is counter to the fan's direction of rotation which is labeled R in FIG. 4. The path P is operated upon by the blades 16 of the fan 14 as air enters and passes through the fan shroud's ejector portion 28.

As best seen in FIG. 3, the fan assembly 14 includes a central hub portion 42 which is operatively attached to an internal combustion engine 44 rearwardly of the radiator 18. A conventional fan assembly 14 usually includes a viscous fluid clutch arrangement 46 which has an input portion attached to the engine shaft and driven by a "V" belt and pulley drive system 48. The viscous clutch unit 46 has a downstream or output side with a mounting shoulder 50 on which the fan's hub 42 is secured by fasteners 52. The fan assembly 14 has a plurality of radially extending blades 16 that are arcuately spaced from one another and extend radially outwardly from the central hub portion 42. The fan blades 16 are preferably identical and each section of the blades has a cord length defining the angle of attack with respect to the straight or head on flow of air which has directly passed through the radiator and into the plane of fan rotation. This air flow also engages the swirling flow of air from the vanes 36 and taking air paths P.

As previously explained, the vanes 36 are separated from one another to form air flow channels or passages 38. The vanes 36 are angled or turned in a desired direction to direct streams of air flow into contact with the fan blading 16. More particularly and as illustrated in FIG. 4, the flow of air from vanes 36 is turned in a direction P against the counter-clockwise rotation R of fan assembly 14. This flow of air against the fan blades 16 advantageously preloads the downstream or suction side of the fan blades so that fan operation is made more effective in pumping air. With the improved pumping action, the fan effectively improves the flow of air through the radiator therefore improving heat transfer efficiency of the engine cooling system.

In addition to an increase of the flow of air through radiator 18, the flow of air through an associated air conditioning condenser 54 is also improved. The condenser 54 is diagrammatically shown in FIG. 2 and is operatively mounted immediately in front of the radiator 18. Typically, condensers are rectangular in shape like a conventional radiator and therefore have comers which are outward of a circular fan 40 just like a rectangular radiator. The arrowed lines 56 illustrates flow of air through the condenser.

Figure 6:
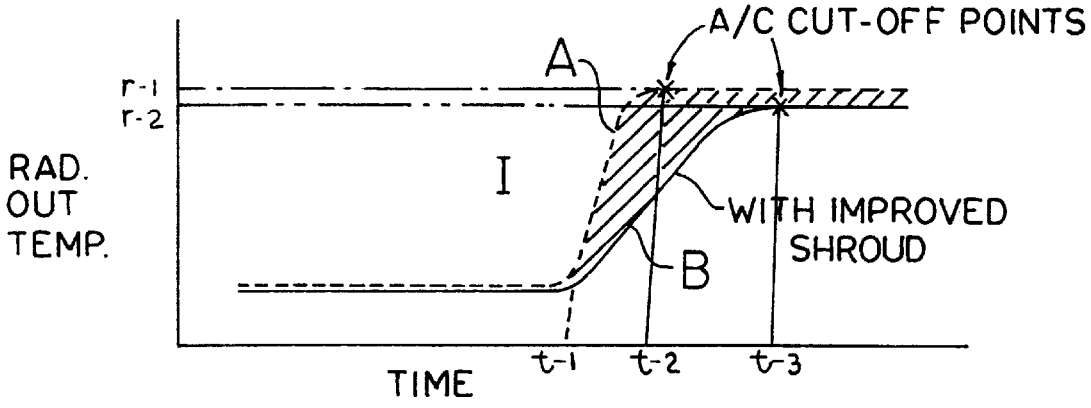
FIG. 6 is a diagram illustrating an operational improvement of the subject fan shroud.

The graph shown in FIG. 6 represents engine cooling system performance with and without the improved fan shroud while the engine is idling which represents a difficult engine cooling condition. The plot A represents by the broken line the operational characteristics of the vehicle's cooling system with a conventional fan shroud without the corner vane structure of the subject fan shroud. As shown by plot A, the radiator coolant temperature rapidly begins to increase at time t-1 to a higher temperature level r-1. In many vehicles this increase in temperature initiates deactivation of the vehicle's air conditioning system by deactivating the compressor clutch. In plot A the air conditioner system of the vehicle is deactivated at about time t-2.

Plot B represents by the unbroken line the operation of the vehicle's cooling system with the subject improved fan shroud with the vane structure identified heretofore. With the improved shroud, the coolant temperature gradually increases from time t-1 until temperature level r-2 is reached. Note that temperature r-2 is cooler than temperature r-1. Also note that the air conditioning deactivation point is delayed from time t-2 to time t-3. The improved shroud accordingly provides greatly improved temperature management and improved air conditioner performance particularly while the vehicle is idling or moving slowly such as in stop and go traffic. The improved performance is manifested by area I between the two plots A and B.

While the invention has been shown and described by the preferred embodiment, it should be clear to those skilled in the art that various changes and modifications may be made thereto without departing from the scope of the following claims.

What is claimed is:

1. In combination with an automotive engine cooling fan having a plurality of radially extending blades, and an engine cooling radiator having corner portions, an improved fan shroud for the engine cooling fan, said fan shroud including an attachment structure to secure the shroud to a support structure within an engine compartment of an automotive vehicle, said fan shroud comprising a generally box like main housing with a fully opened front portion adapted to be affixed in an adjacent and overlying relationship to said engine cooling radiator to receive a flow of air therefrom, said main housing also having a rear wall offset from the adjacent radiator creating a space therebetween, said fan shroud also having a curved air ejector portion extending axially from the rear wall of said main housing and defining a circular opening therein for receiving the bladed fan operatively immersed therein for powered operative rotation in a first direction for drawing air through the engine cooling radiator and exhausting such air through the ejector portion, said main housing having an array of air directing vanes carried by said rear wall and extending radially and outwardly from said circular opening to the peripheral of said rear wall, said vanes being upstream of the fan blades for directing streams of air from the corner portions of the radiator impinging on said rear wall into an inward and rotational swirl through said opening and against the fan blades with the direction of swirl being counter to the direction of operative rotation of the fan so that the swirl of air preloads the fan blades to improve the pumping efficiency of the fan.

2. The fan shroud as set forth in claim 1, wherein said air ejector portion is generally cylindrical and extends axially from said rear wall of said housing.

3. The fan shroud as set forth in claim 1, wherein said main housing is generally rectilinear and defines corner portions extending radially outside of the circular opening defined in said rear wall by said ejector portion and wherein said fluid directing vanes are operatively positioned in said corner portions and terminate at said circular openings and are oriented so as to direct air which flows into said corner portions into the ejector portion in an inward and rotational path counter to the direction of rotation of the fan.

4. An improved fan shroud operatively immersing a bladed fan in an engine cooling system, said fan being selectively rotatable in a first direction for effecting air flow through an engine cooling radiator, said fan shroud having a box like main section with a fully opened and unrestricted entrance face mounted in overlying relationship to the engine cooling radiator including corner regions thereof, said main section also having an inwardly extending rear wall portion spaced from the radiator thus creating a space therebetween and cooperating with said main section to define corner regions, a curved ejector portion extending axially from said rear wall portion and defining a curved opening therein, said ejector portion defining a curved space for accommodating said bladed fan, said main section having a plurality of vanes positioned in the corner regions located outward from said ejector portion, said vanes extending on said rear wall portion and having ends terminating at points adjacent to said curved opening for redirecting the direction of streams of air flowing through the corner regions of said radiator and into said shroud inwardly and onto the pumping surface of said blades to thereby improve the fan efficiency.

5. An improved fan shroud for an engine cooling fan adapted to be supported in the engine compartment of a vehicle for increasing air velocity of a flow through a rectangularly configured radiator through which liquid engine coolant is circulated, comprising: a generally rectilinear main housing section adapted to be secured in overlying relationship to the radiator for receiving the flow of air passing through the radiator, said main housing section being fully opened to the radiator and having a back wall with a circular air flow opening therein, said fan shroud further comprising a generally cylindrical ejector portion extending from said opening in said back wall of said main housing and disposed around said fan blades, said main housing having corner sections radially outside of said fan blades, said corner sections having a plurality of vanes therein located only radially outward of said ejector portion and terminating near said opening, said vanes being inclined to redirect a flow of air into an inward swirling path and in a rotational direction counter to the direction of fan rotation so that some initial velocity is imparted to peripheral air as the air approaches the plane of fan rotation and so that the velocity of the mass of air flowing through the ejector section of said fan shroud is increased.

6. A shroud for an engine driven fan having blades which rotate in a predetermined direction comprising a main body portion and a curved air ejector portion encompassing at least a portion of said fan, said fan having a plurality of arcuately spaced blades extending radially with respect to said axis of rotation and arranged to pump air generally in an axial direction through said air ejector portion, said main body portion of said shroud having a rectilinear and forwardly extending peripheral wall defining a fully opened front for the passage of air therethrough and an air deflecting rear wall extending transversely and inwardly from said peripheral wall to define corner areas therewith said rear wall further extending to said air ejector portion which defines an opening in said rear wall allowing air to pass from said main body portion into said ejector portion, said rear wall carrying a plurality of air deflecting vanes in said corner areas and terminating adjacent to said opening, said vanes being disposed in a predetermined pattern thereon and located only radially outward of said blades of said fan for redirecting streams of air impinging on said rear wall and particularly said corner areas into an inward rotational flow and into said opening and said air ejector portion and onto the pumping surfaces of said fan blades to preload the fan blades for increasing the pumping efficiency of said fan.

7. A shroud as set forth in claim 6 wherein said vanes extend between said peripheral wall and said opening.

8. A shroud as set forth in claim 7 wherein said vane is formed in a curved shape for directing said stream of air flow through said opening and into the fan in a direction opposite of the predetermined rotation of the fan blades.

9. A shroud as set forth in claim 8 wherein said opening is positioned eccentric to said deflecting surface.

10. A shroud as set forth in claim 8 including a plurality of vanes operatively spaced from one another to form air flow channels therebetween to direct streams of air flow into the fan in a direction opposite of the predetermined rotation of the fan blades.

11. A shroud as set forth in claim 10 wherein said vanes are arranged in generally parallel rows between said reinforcing edge and said opening defining air channels between adjacent vanes.

12. A shroud for an engine driven fan having blades which rotate in a predetermined direction, said shroud comprising:

a generally flat air deflecting surface extending from an outer perimeter to a tubular collar defining an air flow opening adapted to receive the fan;

a reinforcing edge disposed along said outer perimeter of said air deflecting surface and extending forwardly therefrom and cooperating therein to define a fully opened air entrance area leading into said shroud and cooperating with said surface to define corner areas therein; and a plurality of vanes having a curved shape extending only between said reinforcing edge and said opening for directing a plurality streams of air flow through said opening and into the fan in a direction opposite of the predetermined rotation of the fan blades.

13. A shroud as set forth in claim 12 wherein said vanes are arranged in generally parallel rows between said reinforcing edge and said opening defining air channels between adjacent vanes for directing a flow of air into said opening and onto said blades of said fan.

14. A combination of an engine cooling fan driven for rotation in one direction about an axis of rotation and a fan shroud fixed with respect to said fan, said shroud having a main body portion and a circular air ejector portion encompassing at least a portion of said fan, said fan having a plurality of arcuately spaced blades extending radially with respect to said axis of rotation and arranged to pump air generally in an axial direction through said air ejector portion, said main body portion of said shroud having a rectilinear and forwardly extending peripheral wall providing an unrestricted air entrance into said shroud and an air deflecting rear wall extending transversely and inwardly from said peripheral wall to define corner areas therewith, said rear wall further extending to said circular air ejector portion, said rear wall carrying a plurality of air deflecting vanes extending from said peripheral wall and across said back wall to terminal points adjacent to said circular air ejector portion, such air ejector portion extending axially from said rear wall and defining a curved opening therein for the passage of air into said air ejector portion and being arranged to redirect streams of air impinging on said rear wall and particularly said corner areas into an inward rotational flow into said air ejector portion and onto the pumping surfaces of said fan blades to preload the fan blades for increasing the pumping efficiency of said fan.

* * * * *